US007562700B2

(12) United States Patent
Lewis et al.

(10) Patent No.: US 7,562,700 B2
(45) Date of Patent: Jul. 21, 2009

(54) WIRELINE SUPPORTED TUBULAR MILL

(75) Inventors: Evan G. Lewis, Kingwood, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 32 days.

(21) Appl. No.: 11/635,840

(22) Filed: Dec. 8, 2006

(65) Prior Publication Data

US 2008/0135226 A1 Jun. 12, 2008

(51) Int. Cl.
*E21B 29/06* (2006.01)

(52) U.S. Cl. ..... 166/55.7; 166/53; 166/298; 175/51; 409/143

(58) Field of Classification Search ..... 166/298, 166/53, 55.7; 175/51, 78; 409/143, 179
See application file for complete search history.

(56) References Cited

U.S. PATENT DOCUMENTS 2,389,235 A * 11/1945 Harrison ..... 166/55.8
3,050,122 A * 8/1962 Huitt et al. ..... 166/55.8
4,185,705 A * 1/1980 Bullard ..... 175/78
4,577,388 A * 3/1986 Wood ..... 29/558
5,183,111 A * 2/1993 Schellstede ..... 166/298
5,392,858 A * 2/1995 Peters et al. ..... 166/298
5,692,565 A * 12/1997 MacDougall et al. ..... 166/264
5,699,866 A * 12/1997 Cousins et al. ..... 175/78
5,701,958 A * 12/1997 Braziel ..... 166/298
6,012,526 A * 1/2000 Jennings et al. ..... 166/298
6,155,343 A * 12/2000 Nazzal et al. ..... 166/55
6,167,968 B1 * 1/2001 Allarie et al. ..... 166/298
6,397,946 B1 * 6/2002 Vail, III ..... 166/250.01
6,772,839 B1 * 8/2004 Bond ..... 166/298
6,868,901 B2 * 3/2005 Mason et al. ..... 166/55.7
6,868,906 B1 * 3/2005 Vail et al. ..... 166/250.01
6,915,853 B2 * 7/2005 Bakke et al. ..... 166/298
7,249,918 B1 * 7/2007 Bowman ..... 409/132
2002/0020562 A1 * 2/2002 Baird ..... 175/78
2002/0053428 A1 * 5/2002 Maples ..... 166/99
2003/0136562 A1 * 7/2003 Robison et al. ..... 166/298
2007/0151731 A1 * 7/2007 Butler et al. ..... 166/298
2007/0151766 A1 * 7/2007 Butler et al. ..... 175/67
2007/0251692 A1 * 11/2007 Billingham ..... 166/297
2008/0000694 A1 * 1/2008 Butler et al. ..... 175/67

* cited by examiner

*Primary Examiner*—Shane Bomar
(74) *Attorney, Agent, or Firm*—Steve Rosenblatt

(57) ABSTRACT

A milling assembly can be delivered downhole on wireline. Once at the desired location, a processor extends centralizing and driving wheels to initially position the assembly. The assembly has a cutter end with one or more mills or cutters that can be selectively radially extended. The entire cutter end can be rotated in an arcuate manner over a predetermined range. One or more cutter can be extended at a time and driven. The wheels are driven either in an uphole or downhole direction at the same time the arcuate motion can take place. Using a processor, different shapes in a surrounding tubular can be made such as windows for laterals, a plurality of openings for production or interior locator surfaces to properly position subsequent equipment with respect to openings already made by the device.

26 Claims, 2 Drawing Sheets

WIRELINE SUPPORTED TUBULAR MILL

FIELD OF THE INVENTION

The field of the invention is mills for tubulars downhole and more particularly wireline run mills that can produce windows or other openings of desired shape and location in the tubular.

BACKGROUND OF THE INVENTION

Conventional ways to make outlets in tubulars, commonly referred to as windows, involve setting a diverter, known as a whipstock, and properly supporting and orienting it. The whipstock can also be run attached to a bottom hole assembly that can include one or more mills and orientation equipment for the whipstock and even an anchor for the whipstock that can be set when the desired orientation is obtained for the whipstock. Milling windows incorporates possibilities that something could go different from plan. Mills can bore into the whipstock instead of being urged along its ramped surface until the casing wall is penetrated and an exit is made. Mills can become dull or make too early an exit that can result in the window being too short. The mills can become dull during the window forming procedure or the anchor for the whipstock can prematurely release. Typically windows made by the whipstock need to be very long because ramp angles on the whipstock are very small, in the order of about three degrees or less to avoid bogging down the widow mill with extreme lateral forces to get it to go through the wall. Windows are also made in stages with sequential mills that in series make the window wider than the previous mill. Using such systems of ever larger mills requires the system to withstand bending moments as progressively larger mills get onto the whipstock ramp and start widening the already started window. At times, the stress levels become excessive and connection failures are known to occur between mills.

Openings in tubulars are needed for other purposes such as normal production from the surrounding formation. Many times that is accomplished with perforating guns. The problems with perforating guns are the safety concerns of handling explosives and the potential for formation damage from shooting off the guns as well as other subsidiary issues of proper placement and support for the guns and retrieval after they are shot off.

While guns can be run in wireline for fast delivery to the desired location, assuming that the well is not too deviated, milling assemblies are run in on a tubular string that is either rotated from the surface or includes a downhole mud motor to rotate the mills.

The present invention takes a fresh approach to providing openings in tubulars that avoids many of the issues discussed above. In the preferred embodiment, an assembly is delivered on wireline for rapid deployment into the wellbore. The assembly comprises a processor which can selectively actuate a combination guiding and anchoring system that allows the assembly to be initially positioned in the desired spot and moved longitudinally to fashion any shape of opening or openings desired in a predetermined location or locations. One or more cutters can be extended for milling and the cutters can be moved in a predetermined arc while the assembly is moved uphole or downhole. Spare cutters are envisioned to allow a specific job to be finished without bit change or/and to allow the job to be completed faster. The rate of uphole or downhole movement can be controlled. The assembly can even make locating grooves for proper positioning of subsequent equipment after the desired opening or openings are made. These and other advantages of the present invention will be more apparent to those skilled in the art from a review of the drawings and description associated with the preferred embodiment while recognizing that the full scope of the invention is in the associated claims.

SUMMARY OF THE INVENTION

A milling assembly can be delivered downhole on wireline. Once at the desired location, a processor extends centralizing and driving wheels to initially position the assembly. The assembly has a cutter end with one or more mills or cutters that can be selectively radially extended. The entire cutter end can be rotated in an arcuate manner over a predetermined range. One or more cutter can be extended at a time and driven. The wheels are driven either in an uphole or downhole direction at the same time the arcuate motion can take place. Using a processor, different shapes in a surrounding tubular can be made such as windows for laterals, a plurality of openings for production or interior locator surfaces to properly position subsequent equipment with respect to openings already made by the device.

DETAILED DESCRIPTION OF THE PREFERRED EMBODIMENT

Figure 1:
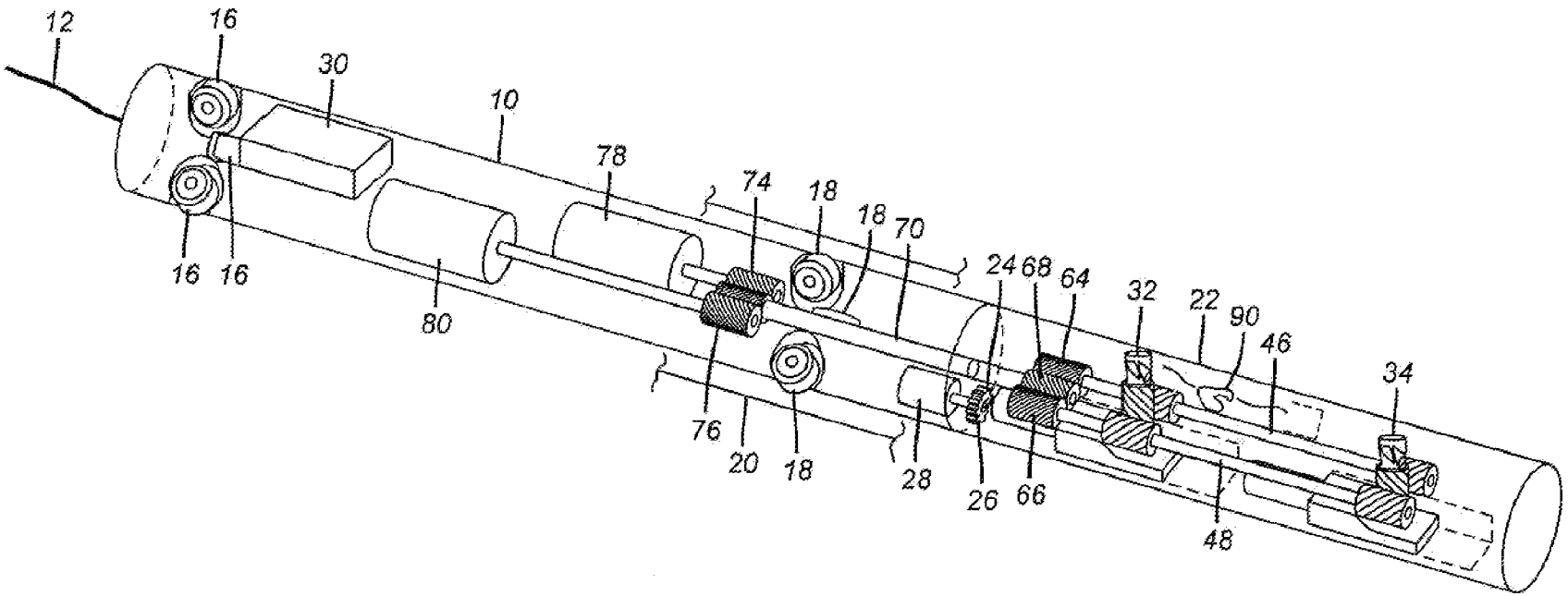
FIG. 1 is a perspective of a twin cutter assembly with one cutter extended.

FIG. 1 shows a body or main housing 10 that is preferably supported by a wireline 12 to power a processor 30 and other equipment, as will be described below. The body 10 has a set up uphole wheels 16 and downhole wheels 18. Preferably each wheel set comprises three wheels at 120 degree spacing but other arrangements are possible. Instead of wheels other types of devices that can selectively contact the surrounding tubular, shown schematically as 20 are also envisioned. One example is tracks instead of retractable and driven wheels that are shown. It is preferred that all the wheels be retractable for quick run in and when in the proper location downhole that they are extendable to engage the tubular 20 to not only centralize the housing 10 with respect to tubular 20 but also to allow the housing 10 to be driven uphole or downhole with respect to the tubular 20.

Housing 10 has a rotating component 22 that can be turned with respect to housing 10 when wheels 16 and 18 are extended. This occurs by the turning of a sun gear 24 around a planetary gear 26 (shown only in part and schematically). Thus the rotating component 22 while being coaxial with housing 10 can rotate about its common longitudinal axis with housing 10. A motor 28 controlled by processor 30 can selectively turn the housing 22 clockwise or counterclockwise.

Housing 22 is illustrated with cutters or mills 32 and 34. Although two mills are shown, one or more mills can be incorporated into the design. The terms cuter, mill, drill or bit and other synonymous terms are intended to be interchangeable for the purposes of this description. The mills 32 or 34 are selectively extended radially by ramps 36 or 38 by virtue of motors 40 or 42 attached to them for translating them. Thus, when raised surface 44 is under cutter 34 the cutter 34 is extended up to a maximum extension shown in FIG. 2. The amount of radial extension is controlled by processor 30 regulating motor 42 so that the amount of radial extension can be held constant at a given value or varied with time as the milling progresses at a speed that is dependent on either predetermined patterns or in real time depending on the actual milling progress being made or the resistance experienced by an extended cutter. The ramp assemblies 36 and 38 are mounted to the housing 22 and rotate with it. Similarly, driven shafts 46 and 48 are also supported by the housing 22 and rotate with it. Bevel gears 50 and 52 are mounted respectively on shafts 46 and 48 and they each engage driven gear 54 that is secured to mill 34. Gear 54 is mounted to housing 22 to move radially when mill 34 is extended by longitudinal movement of ramp assembly 38, for example. Housing 22 supports gear 54 through a slot (not shown) in ramp assembly 38 so as to allow translation of ramp 38 in opposed longitudinal directions to force mill 34 out or to allow it to back up in the opposed direction, such as for run in or pulling out of the hole. Ramp assembly 38 can be driven in opposed directions by a threaded shaft 56 and the same assembly can be applied to ramp assembly 36. The shaft such as 56 can act to change the position of either mill between the maximum extended position of either of the mills 32 or 34 and the fully retracted position. Alternatively, motors 40 or 42 can be stepper motors to advance or withdraw an associated ramp in predetermined increments so that the gear 54 and associated mill 34 can be extended or allowed to retract a predetermined amount along ramp 58, for example. In the preferred embodiment, identical operation is envisioned for mill 32 that is connected to driven bevel gear 60, which rides on ramp surface 62. Bevel gears 64 and 66 mounted to shafts 46 and 48 respectively, drive gear 60. At the uphole end of shafts 44 and 46 are bevel gears 64 and 66 which mesh with gear 68 connected to shaft 70. Shaft 70 has a gear 72 near its uphole end that is driven by gears 74 and 76 that are respectively driven by motors 78 and 80 that are also controlled by processor 30.

Figure 2:
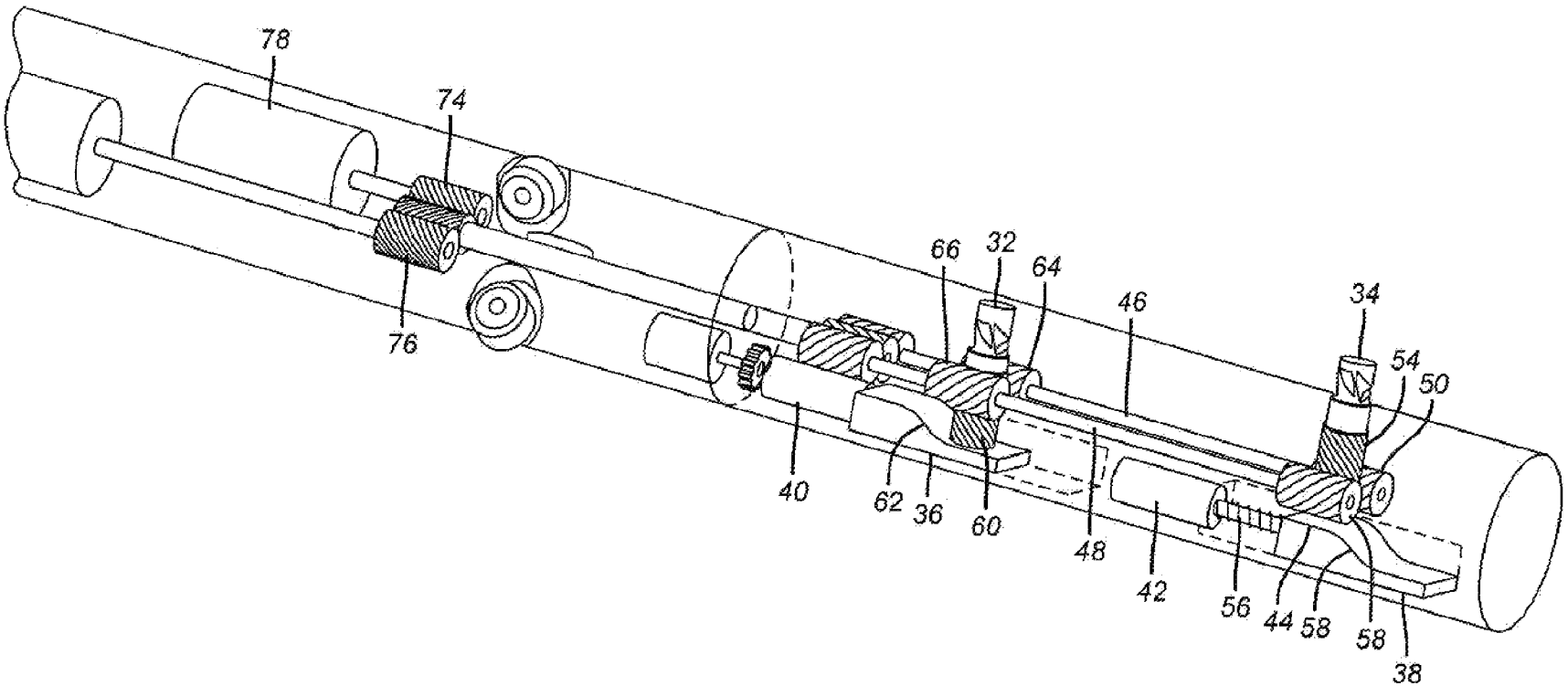
FIG. 2 is a close up view of the downhole end of the tool from FIG. 1 with the other cutter extended.

In operation, the tool is run in the hole with the wheels 16 and 18 retracted so that delivery can be accomplished in the shortest time. The processor 30 has features to determine the orientation of the mills 32 and 34 much in the way an MWD tool determines the orientation of a whipstock downhole before it is anchored. Mills 32 and 34 are also retracted for run in and do not turn for run in. When the proper depth is determined using known techniques, the wheels 16 and 18 are extended to centralize the tool in the tubular 20 as well as to get traction for driving the tool uphole and downhole as determined by processor 30. If a window is to be milled, it can be produced from downhole moving up or from uphole going down or even from opposed ends toward a middle of the window. A single mill, such as 34, can be extended, as shown in FIG. 2. This is done through processor 30 commanding the motor 42 to drive ramp assembly 38 so that ramp 58 can push out gear 54 to extend mill 34. Processor 30 then can operate motors 78 and 80 to ultimately drive gears 50 and 52 in the manner described before to get mill 34 turning. At this time mill 32 may also be rotating but it is not extended. Processor 30 has the capacity to operate with more than on mill extended at a time. Thus, for example, if a random or ordered hole pattern is required, as a way of avoiding having to perforate, more than one mill can be extended for making round holes. In the embodiment illustrated the rotation of component 22 rotates both mills 32 and 34 a like amount forcing them to be longitudinally aligned at all times. However, a separate drive for each mill is contemplated. Those skilled in the art will appreciate that one portion of housing 22 will need to be rotatable with respect to another and the driving systems from motors 78 and 80 will need to be independently operated. If this is done, even an oblong window can be milled with two mills operating making two different shapes of a typical window at the same time which in the end results in a single window made to the preprogrammed shape specification. As previously stated one mill can simply be a backup for the other mill so that a given opening can be finished if one mill gets dull or breaks without having to trip out of the hole. By preprogrammed regulation of the driving rate for the wheels 16 or/and 18 and the movement of motor 28 that controls the left to right movement of either or both mills 34 or/and 32 while coupled with associated ramp control for mill extension by controlling the associated motor 40 and/or 42 any shaped opening can be produced in any tubular regardless of its wall thickness.

The tool of the present invention can perforate a tubular in an ordered or random pattern, to avoid having to use a perforating gun that can have adverse effects on the formation. It can also be used to make a window in the shame shape as a multi-mill bottom hole assembly currently makes it when used in conjunction with a whipstock. For example the window can be wider at the top to approximate the diameter of the largest mill being used while becoming more slender at the bottom to approximate what happens when the mills make a departure from the whipstock ramp. Alternatively, a totally different window shape can be made. Rather than going clean through the tubular wall, only some material can be removed from its inside wall leaving a thinner wall to be penetrated by a milling bottom hole assembly in conjunction with a whipstock. Independently, the tool of the present invention can strategically produce radial grooves in the inner wall of the tubular to act as locators for packers or other downhole tools that need to be positioned with respect to the hole or holes just produced.

Other features can be provided that have been left off the drawings for greater clarity of the operation of the milling equipment. Passages can be incorporated though the housing 10 or external grooves that will allow flow with cuttings to be circulated or reverse circulated. A downhole pump can aid in such fluid movements. Alternatively the housing 22 can accept and trap cuttings in a screen basket as long as the rotating components are suitably isolated from the captured cuttings. This method is schematically illustrated as 90. Such cuttings can be retained with magnets or baskets mounted in housing 22. While the tool is preferably run in on wireline 12 it can also be delivered on coiled tubing or jointed tubing, either of which will greatly facilitate circulation or reverse circulation for the purpose of capturing cuttings.

While longitudinally shifting ramp assemblies 36 and 38 are illustrated, those skilled in the art will appreciate that other equivalent techniques for extending and retracting the mills 32 and 34 can be used. These mills can be operated in tandem or have totally separate controls so that one mill can either back up the other one if there is a problem or both mills can work on a hole or hole pattern at the same time to expedite the job. While two mills are illustrated fewer or additional mills can be used either as backups or at the same time to shorten the operation.

The above description is illustrative of the preferred embodiment and many modifications may be made by those skilled in the art without departing from the invention whose scope is to be determined from the literal and equivalent scope of the claims below.

We claim:

1. A downhole tubular milling assembly, comprising:

a main housing operably connected to a cutter housing, said housings featuring a longitudinal axis, said cutter housing selectively rotatable relative to said main housing about said longitudinal axis in at least one of a clockwise or counterclockwise direction;

at least one cutter operably mounted to said cutter housing and selectively extendable therefrom to allow a plurality of patterns of milling on the tubular while said housings controllably move axially in tandem in the tubular as said housings controllably relatively rotate, said controlled axial and relative rotational movements comprising the sole guidance for the shape milled by said cutter.

2. The assembly of claim 1, wherein:

said cutter is selectively extendable with respect to said longitudinal axis of said cutter housing in a radial direction.

3. The assembly of claim 1, wherein:

said main housing further comprises a retractable drive mechanism.

4. The assembly of claim 3, wherein:

said drive mechanism centralizes said housing in the tubular when extended.

5. The assembly of claim 3, wherein:

said cutter is selectively retractable to a position where it extends no further than said main housing.

6. The assembly of claim 5, wherein:

a processor in said main housing controls the movement of said drive mechanism and said cutter.

7. The assembly of claim 6, wherein:

said processor can command said drive mechanism to drive uphole or downhole while said cutter is rotated clockwise or counterclockwise so as to control the shape of milling on the tubular.

8. The assembly of claim 7, wherein:

said main housing is supported on a wireline to provide power to said processor and to operate said cutter.

9. The assembly of claim 7, wherein:

said cutter housing is motor driven for clockwise or counterclockwise rotation with respect to said main housing by a motor mounted to said main housing.

10. The assembly of claim 9, wherein:

said cutter is driven about its own axis by at least one motor mounted on said main housing.

11. The assembly of claim 10, wherein:

said at least one cutter comprises at least two cutters that are selectively independently radially extended or retracted from said cutter housing.

12. The assembly of claim 11, wherein:

said cutters are driven to rotate on their own axis in tandem.

13. The assembly of claim 11, wherein:

said cutters are independently driven to rotate on their own axis.

14. The assembly of claim 11, wherein:

said cutters and said cutter housing in which they are mounted are movable clockwise and counterclockwise with respect to said main housing and said cutters are radially extendable either in tandem or independently.

15. The assembly of claim 14, wherein:

said cutters selectively cut different portions of what becomes a single window in the tubular at the same time.

16. The assembly of claim 9, wherein:

said cutter housing further comprises a fluid circulation device to lead cuttings to a capture device thereon.

17. The assembly of claim 7, wherein:

said cutter is selectively ramped radially in or out while rotating with said cutter housing clockwise or counterclockwise.

18. The assembly of claim 1, wherein:

said cutter selectively cuts a locating groove in the inside of the tubular.

19. The assembly of claim 1, wherein:

said cutter selectively produces sufficient holes in the tubular so that perforation can be avoided.

20. The assembly of claim 1, wherein:

said cutter selectively mills a window in the tubular for a lateral.

21. A downhole tubular milling assembly, comprising:

a main housing operably connected to a cutter housing, said housings featuring a longitudinal axis, said cutter housing selectively rotatable relative to said main housing about said longitudinal axis in at least one of a clockwise or counterclockwise direction;

at least one cutter operably mounted to said cutter housing and selectively extendable therefrom to allow a plurality of patterns of milling on the tubular;

said main housing further comprises a retractable drive mechanism;

said cutter is selectively retractable to a position where it extends no further than said main housing;

a processor in said main housing controls the movement of said drive mechanism and said cutter;

said processor can command said drive mechanism to drive uphole or downhole while said cutter is rotated clockwise or counterclockwise so as to control the shape of milling on the tubular;

said cutter housing is motor driven for clockwise or counterclockwise rotation with respect to said main housing by a motor mounted to said main housing;

said cutter is driven about its own axis by at least one motor mounted on said main housing;

said cutter is straddled by parallel driven shafts from said motor and is disposed perpendicular to said shafts and operably engaged to them by gears.

22. The assembly of claim 21, wherein:

said motor has an output shaft whose axis is fixed in said main housing while said gears allow said parallel driven shafts to rotate with said cutter housing while still engaged by said gears.

23. A downhole tubular milling assembly, comprising:

a main housing;

at least one cutter operably mounted to said main housing whose movement is controlled with respect to said main housing to allow a plurality of patterns of milling on the tubular;

said main housing further comprises a retractable drive mechanism;

said cutter is selectively retractable to a position where it extends no further than said main housing;

a processor in said main housing controls the movement of said drive mechanism and said cutter;

said processor can drive said drive mechanism uphole or downhole while said cutter is rotated clockwise and counterclockwise with respect to a longitudinal axis of said main housing so as to control the shape of milling on the tubular;

said cutter is mounted on a motor driven rotatable portion supported by said main housing;

said cutter is driven by at least one motor mounted on said main housing;

said cutter is straddled by parallel driven shafts from said motor and is disposed perpendicular to said shafts and operably engaged to them by gears;

said motor has an output shaft whose axis is fixed in said main housing while said gears allow said parallel driven shafts to rotate with said rotatable portion while still engaged by said gears;

said output shaft is driven by more than one motor;

said cutter comprises more than one cutter with each cutter driven by said parallel shafts.

24. The assembly of claim 23, wherein:

said cutters are connected to said shafts with bevel gears and are independently movable radially by an individual powered ramp.

25. A downhole tubular milling assembly, comprising:

a main housing;

at least one cutter operably mounted to said main housing whose movement is controlled with respect to said main housing to allow a plurality of patterns of milling on the tubular;

said main housing further comprises a retractable drive mechanism;

said cutter is selectively retractable to a position where it extends no further than said main housing;

a processor in said main housing controls the movement of said drive mechanism and said cutter;

said processor can drive said drive mechanism uphole or downhole while said cutter is rotated clockwise and counterclockwise with respect to a longitudinal axis of said main housing so as to control the shape of milling on the tubular;

said cutter is selectively driven radially in or out while rotating clockwise or counterclockwise;

said cutter is movable radially with a driven ramp controlled by said processor.

26. The assembly of claim 25, wherein:

said ramp is engaged to a threaded drive shaft for opposed longitudinal movement to regulate the radial extension of said cutter.

* * * * *